US009648999B2

(12) United States Patent
Uphoff et al.

(10) Patent No.: US 9,648,999 B2
(45) Date of Patent: May 16, 2017

(54) ROBOTIC VACUUM CLEANER HAVING A ROTATING BRUSH ROLLER AND CLEANING METHOD FOR A BRUSH ROLLER OF A ROBOTIC VACUUM CLEANER

(71) Applicant: Miele & Cie. KG, Guetersloh (DE)

(72) Inventors: Carina Uphoff, Bielefeld (DE); Markus Thamm, Leopoldshoehe (DE)

(73) Assignee: MIELE & CIE. KG, Guetersloh (DE)

( * ) Notice: Subject to any disclaimer, the term of this patent is extended or adjusted under 35 U.S.C. 154(b) by 142 days.

(21) Appl. No.: 14/791,498

(22) Filed: Jul. 6, 2015

(65) Prior Publication Data

US 2016/0015233 A1 Jan. 21, 2016

(30) Foreign Application Priority Data

Jul. 17, 2014 (DE) ..... 10 2014 110 025

(51) Int. Cl.

*A47L 9/04* (2006.01)
*A47L 9/06* (2006.01)
*A46B 17/06* (2006.01)

(52) U.S. Cl.

CPC ..... *A47L 9/0477* (2013.01); *A47L 9/0455* (2013.01); *A47L 9/0494* (2013.01); *A47L 9/0606* (2013.01); *A46B 17/06* (2013.01); *A47L 2201/00* (2013.01); *A47L 2201/02* (2013.01)

(58) Field of Classification Search

CPC .. A47L 9/0606; A47L 9/0455; A47L 2201/02; A47L 9/0494; A47L 2201/00; A47L 9/0477; A46B 17/06

See application file for complete search history.

(56) References Cited

U.S. PATENT DOCUMENTS

| | | | | |
|---|---|---|---|---|
| 5,482,562 A * | 1/1996 | Abernathy | A46B 13/02 | 134/33 |
| 2006/0037170 A1* | 2/2006 | Shimizu | A47L 9/0477 | 15/319 |
| 2008/0047092 A1* | 2/2008 | Schnittman | A47L 9/106 | 15/319 |
| 2009/0229075 A1 | 9/2009 | Eriksson | | |
| 2012/0013907 A1* | 1/2012 | Jung | A47L 9/106 | 356/438 |
| 2013/0192022 A1* | 8/2013 | Eriksson | A46B 13/006 | 15/383 |
| 2013/0192023 A1* | 8/2013 | Eriksson | A46B 13/006 | 15/383 |
| 2014/0130272 A1* | 5/2014 | Won | A47L 9/106 | 15/3 |

FOREIGN PATENT DOCUMENTS

| | | |
|---|---|---|
| DE | 10242257 A1 | 4/2003 |
| DE | 202011110010 U1 | 8/2012 |
| EP | 0563116 A1 | 10/1993 |
| WO | WO 2013060365 A1 | 5/2013 |

* cited by examiner

*Primary Examiner* — Alexander Markoff
(74) *Attorney, Agent, or Firm* — Leydig, Voit & Mayer, Ltd.

(57) ABSTRACT

A robot vacuum cleaner includes a housing and a brush roller disposed at a bottom of the housing. The brush roller is configured to be rotatable about a horizontal axle. A blade is disposed above the brush roller in stationary relation with respect to the housing. The horizontal axle is adjustable in height relative to the housing. The brush roller is spaced away from the blade in a lower position and is in engagement with the blade in an upper position.

8 Claims, 3 Drawing Sheets

ROBOTIC VACUUM CLEANER HAVING A ROTATING BRUSH ROLLER AND CLEANING METHOD FOR A BRUSH ROLLER OF A ROBOTIC VACUUM CLEANER

CROSS-REFERENCE TO PRIOR APPLICATION

Priority is claimed to German Patent Application No. DE 10 2014 110 025.5, filed on Jul. 17, 2014, the entire disclosure of which is hereby incorporated by reference herein.

FIELD

The present invention relates to a robot vacuum cleaner having a brush roller which is disposed at a bottom of a housing of the robot vacuum cleaner and rotatable about a horizontal axle. The present invention also relates to a method for cleaning a rotatable brush roller of such a robot vacuum cleaner.

BACKGROUND

Vacuum cleaner robots are autonomous cleaning appliances which serve for automated cleaning of surfaces without having to be pushed or maneuvered by a user. Typically, the appliances are cordless to be able to navigate across an area to be cleaned, for example within a home, without difficulty and without the risk of a power cable getting tangled with furniture or other obstacles. The robot vacuum cleaner receives its power from rechargeable on-board batteries which may be recharged, possibly by the robot vacuum cleaner itself, at a charging station positioned within the home.

Due to the limited capacity of the rechargeable on-board batteries, the suction power of a suction fan motor of the robot vacuum cleaner is often lower than would be desirable for the cleaning process. For this purpose, robot vacuum cleaners of the above-mentioned type are provided with a rotating brush roller to assist the suction fan. The brush roller is disposed at the bottom of the housing of the robot vacuum cleaner, typically in the immediate vicinity of a suction opening of the robot vacuum cleaner. As the bristles of the brush roller rotate about a horizontal axle, they stir up dirt particles that have been caught, for example, in a carpet, making it easier for them to be sucked in and thus received by the suction opening of the robot vacuum cleaner.

One problem of such brush rollers is that threads and/or hairs may become wound around the brush roller as it rotates, as a result of which the bristles of the brush roller become clogged and contribute less effectively to the cleaning of the underlying surface. Wound-up hairs or threads could heretofore only be manually removed from the brush roller.

International Patent Publication WO 2013/060365 A1 describes a floor nozzle for a conventional vacuum cleaner, which floor nozzle has a rotating brush roller disposed therein. In order to clean the brush roller of hairs or threads, this floor nozzle has a blade which is disposed above the brush roller and which can be lowered onto the brush roller by operating a foot switch. The blade then cuts hairs and threads into smaller pieces while the brush roller is rotating and lifts them off the brush roller so that they can be sucked in.

However, the system and procedure described are not suitable for an autonomous robot vacuum cleaner, inter alia, because of the manual operation.

SUMMARY

A robot vacuum cleaner includes a housing and a brush roller disposed at a bottom of the housing. The brush roller is rotatable about a horizontal axle. A blade is disposed above the brush roller in stationary relation with respect to the housing. The horizontal axle is adjustable in height relative to the housing. The brush roller is spaced away from the blade in a lower position and is in engagement with the blade in an upper position.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

In an embodiment, the present invention provides a robot vacuum cleaner in which a blade is disposed above the brush roller in stationary relation with respect to the housing, and in that the axle of the brush roller is adjustable in height relative to the housing, the brush roller being spaced away from the blade when in a lower position, and the brush roller being in engagement with the blade when in an upper position. Thus, in accordance with the present invention, it is not the blade but the brush roller that is vertically movably mounted in order to bring the brush roller and the blade into engagement with one another so as to free the brush roller from hairs and threads. The mobility of the robot vacuum cleaner can advantageously be used to move it onto a suitable element in order to bring the brush roller into the upper position for cleaning. Thus, the cleaning position can be assumed without the need to provide a separate adjustment means for the brush roller or the blade.

In an advantageous embodiment of the robot vacuum cleaner, the axle of the brush roller is mounted in laterally disposed bearings, which in turn are vertically movably guided in guides. This enables the brush roller to be vertically moved using a structurally simple means. Preferably, the brush roller is urged into a lower position by springs.

In an advantageous embodiment of the robot vacuum cleaner, the blade is configured to extend over substantially the entire width of the brush roller. Preferably, the blade points obliquely downwardly. These two features make it possible to achieve a good cleaning effect for the entire brush roller.

A method according to the present invention for cleaning a brush roller of a robot vacuum cleaner includes the following steps: The robot vacuum cleaner travels to a charging station and moves onto a ramp, whereby the brush roller is raised relative to a housing of the robot vacuum cleaner and brought into engagement with a blade disposed above the brush roller in the housing of the robot vacuum cleaner. Then, the brush roller is rotated while in engagement with the blade in order to clean the brush roller and particularly to remove hairs and/or threads. The advantages obtained are those mentioned in connection with the robot vacuum cleaner. The brush roller is moved into the upper cleaning position through the interaction of the robot vacuum cleaner and the charging station without the need to provide additional adjustment means on the robot vacuum cleaner for this purpose.

In an advantageous embodiment of the method, the brush roller rotates for a predetermined period of time at a speed higher than an operating speed of the brush roller during vacuuming This allows for effective cleaning in a short period of time. Preferably, a suction fan of the robot vacuum cleaner is operated while the brush roller is rotating in the raised position.

Figure 1:
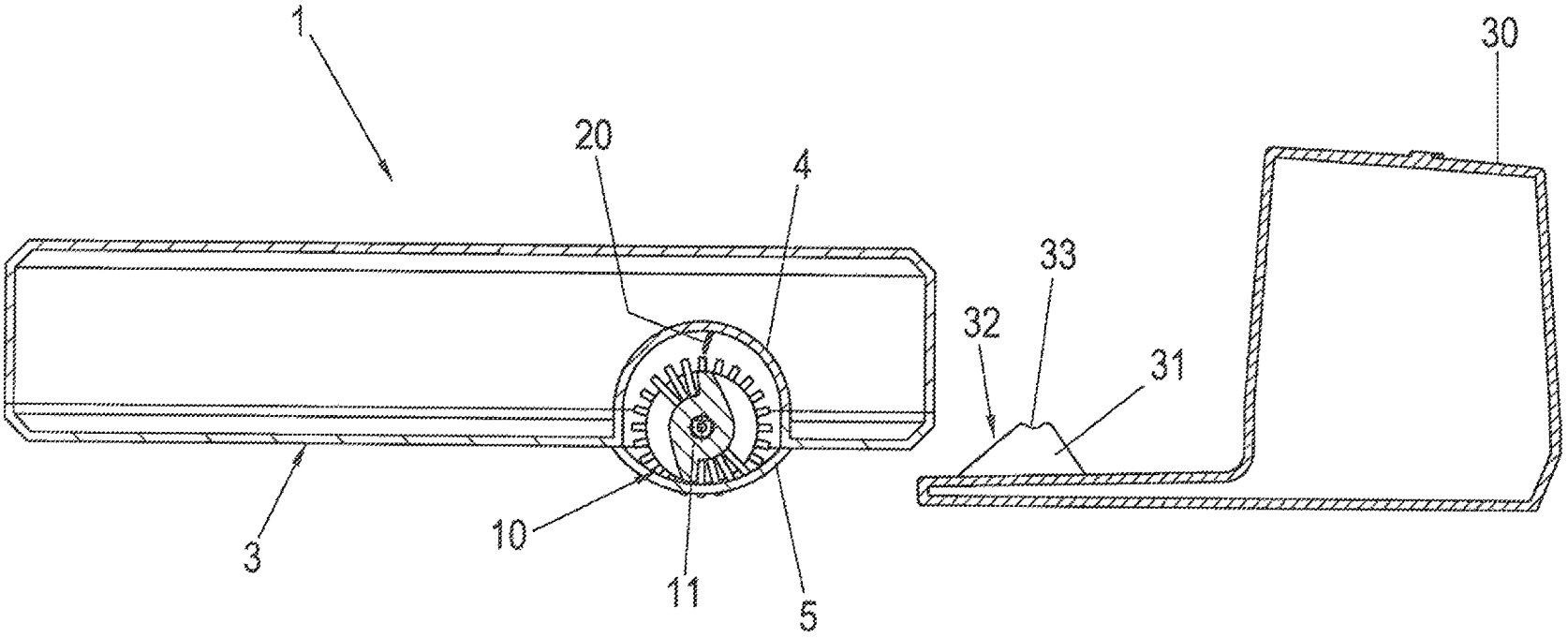
FIG. 1 is a sectional view of a robot vacuum cleaner and an associated charging station.

In FIG. 1, an autonomous robot vacuum cleaner 1 is shown in a schematic sectional view. The section is taken along a longitudinal axis of robot vacuum cleaner 1 extending in the direction of travel. In the view of FIG. 1, robot vacuum cleaner 1 is located just in front of an also depicted charging station 30.

Robot vacuum cleaner 1 has a housing 2 having a bottom 3. In the front region of housing 2, bottom 3 has a tunnel-like recess 4 accommodating a brush roller unit 10 having a brush roller 11. A blade 20 is disposed above brush roller 11. Brush roller 11 and blade 20 are oriented transversely to the longitudinal axis, and thus to the plane of section of FIG. 1.

The housing of robot vacuum cleaner 1 accommodates a drive system which acts on two drive wheels 5, of which only one is shown and referenced in FIG. 1. Drive wheels 5 may be driven independently of each other by drive motors. Further, robot vacuum cleaner 1 is provided in its rear portion with a support wheel, which may either be capable of swiveling or take the form of a ball capable of rotating in any direction. When the directions of rotation and/or the rotational speeds of drive wheels 5 are controlled independently of each other, robot vacuum cleaner 1 is thus able to perform movements with independently adjustable rotational and translational velocities on a surface to be cleaned.

Further, housing 2 of robot vacuum cleaner 1 accommodates a suction system in which a suction opening located in the region of brush roller unit 10 cooperates in a known manner with a filter system, such as a vacuum cleaner bag, and with a suction fan motor. Other elements provided for the operation of robot vacuum cleaner 1 include a rechargeable power supply battery, charging terminals for the battery, a feature for removing the vacuum cleaner bag, or a controller (microcontroller), as well as sensors used for navigation and/or obstacle detection.

Charging station 30 serves, inter alia, for charging a rechargeable battery of robot vacuum cleaner 1. To this end, robot vacuum cleaner 1 may travel to charging station 30, whereupon energy may be transferred through contacts or wirelessly, such as inductively, in order to charge the rechargeable battery. The additional functionality of charging station 30, which is relevant in the context of the method according to the present application, will be described in more detail in connection with FIG. 3.

Figure 2:
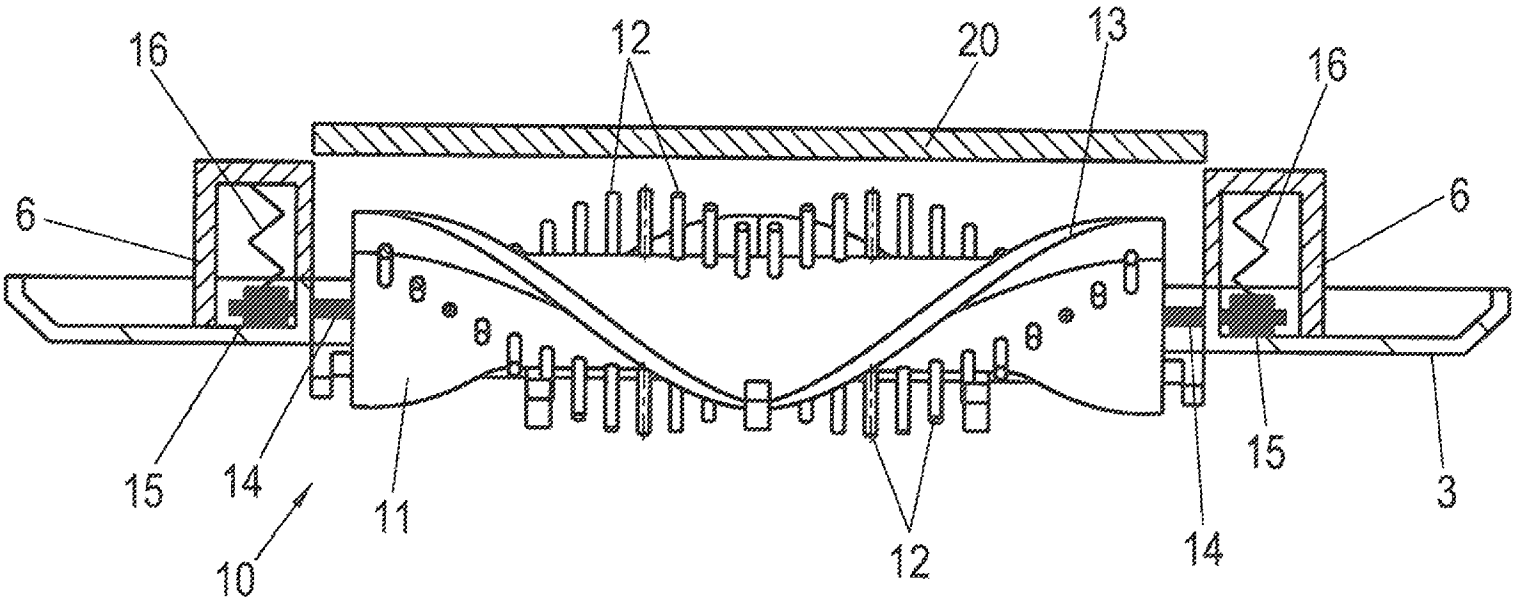
FIG. 2 is a sectional view of robot vacuum cleaner 1, showing the region of its brush roller.

In FIG. 2, the region of brush roller unit 10 of robot vacuum cleaner 1 is shown in a partially sectional view. The section is taken transversely through housing 2 of robot vacuum cleaner 1. For clarity of illustration, brush roller 11 is not shown in section, but in elevation.

Brush roller 11 has a plurality of bristles 12 arranged in several rows in wavy lines along brush roller 11. Provided between the rows of bristles 12 are ribs 13, which also extend in a wavy lines. These ribs 13 prevent picked-up hairs and/or threads from working themselves deeply into bristles 12, from where they are difficult to remove. However, the method for cleaning brush roller 11 according to the present application may also be performed on a brush roller without such ribs.

Brush roller 11 is connected to a horizontal axle 14. Via this axle 14, brush roller 11 can be set into rotation by an electric motor. Axle 14 is supported at both ends in bearings 15, such as plain bearing bushings or rolling element bearings. Bearings 15 are not firmly connected to housing 2, but vertically movably guided in guides 6. Guides 6 are fixedly attached to housing 2 or formed as part thereof Springs 16 are provided to urge bearings 15 downwardly relative to housing 2.

The lower position shown in FIG. 2 is also the operating position of brush roller 11 during the cleaning operation. FIG. 1 also shows brush roller 11 in this position, in which the ends of bristles 12 extend downwardly slightly beyond the periphery of drive wheels 5.

The illustrated vertical mobility of brush roller 11 is advantageous, for example, when unevenness in the floor is encountered by robot vacuum cleaner 1 during the cleaning operation. In the case of a brush roller that cannot be moved vertically relative to housing 2, there is a risk that robot vacuum cleaner 1 may get caught on an obstacle with its brush roller, and may therefore be unable to pass over this obstacle. In such a case, vertically movable brush roller 11 may yield upwardly, thereby reducing the risk of robot vacuum cleaner 1 getting stuck.

A blade 20 is disposed above brush roller 11 and extends transversely over the entire width of brush roller 11. This blade 20 serves for cleaning brush roller 11, and particularly for removing hairs and/or threads. When brush roller 11 is in the operating position shown in FIGS. 1 and 2, the tips of bristles 12 are spaced away from blade 20. A cleaning effect sets in when blade 20 is in engagement with bristles 12 of brush roller 11. To this end, brush roller 11 is moved from its lower operating position to an upper position, also referred to as the cleaning position. Hairs and threads or the like are cut on blade 20 and removed from the bristles, particularly while brush roller 11 is rotating in the cleaning position, whereupon they may be sucked in. To this end, blade 20 is preferably disposed obliquely, as shown in FIG. 1. The direction of rotation of brush roller 11 and/or its obliquity are selected such that bristles 12 move away from the projecting edge of obliquely oriented blade 20.

A method for cleaning brush roller 11 according to the present application will be described hereinafter in connection with FIG. 3.

Figure 3:
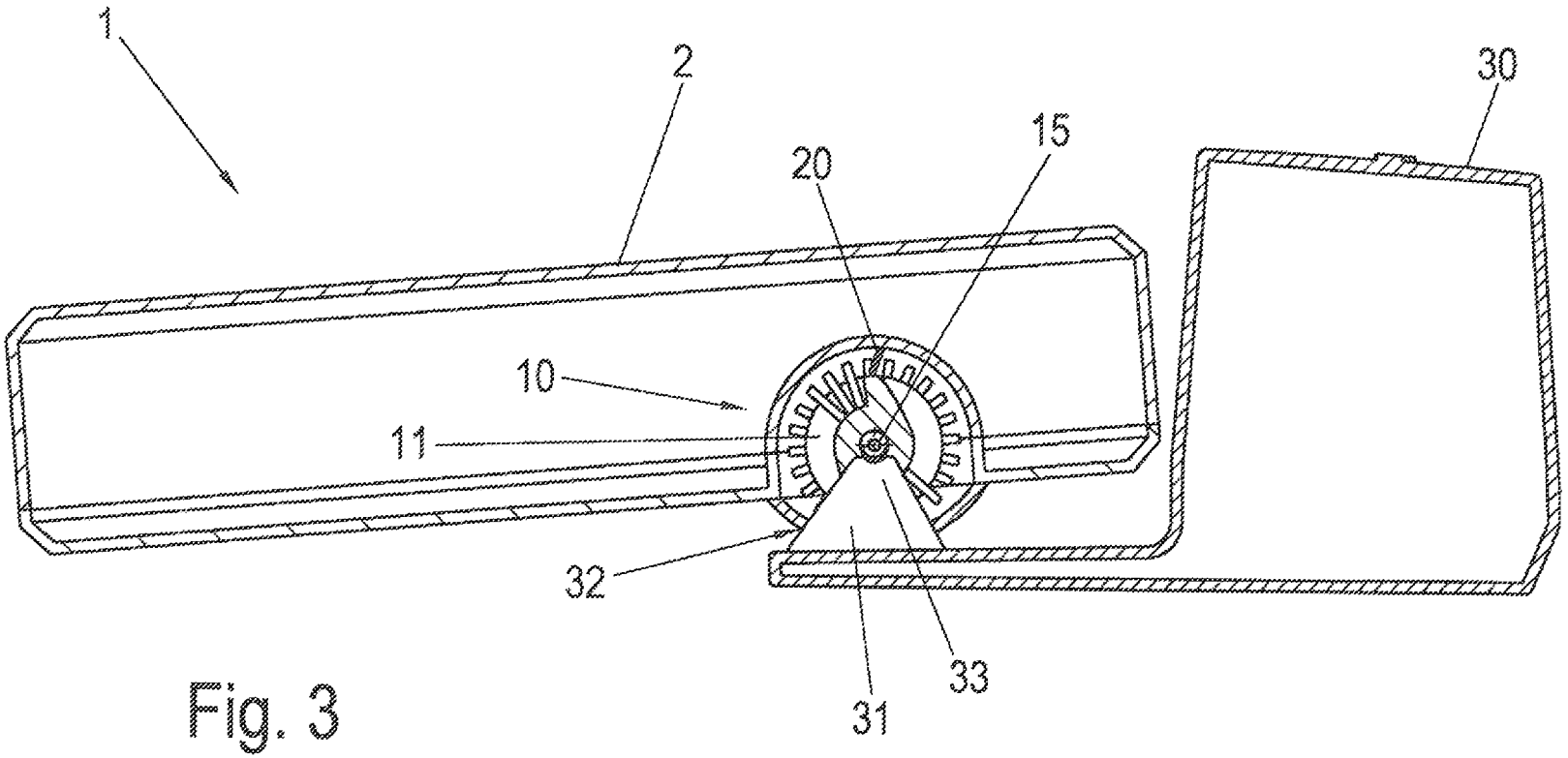
FIG. 3 is a view showing the robot vacuum cleaner of FIG. 1 in a charging position on the charging station.

FIG. 3 shows robot vacuum cleaner 1 of FIG. 1 in a charging position on charging station 30. In this situation, as described earlier in connection with FIG. 1, charging station 30 and robot vacuum cleaner 1 are conductively or inductively coupled in order to charge the rechargeable batteries of robot vacuum cleaner 1.

Independently of the charging function of charging station 30, an interaction of robot vacuum cleaner 1 and charging station 30 is used in accordance with the present application to move brush roller 11 into the upper cleaning position. For this purpose, charging station 30 is provided at the sides with ramps 31 having a forwardly directed, upwardly sloping cam surface 32 and a depression 33 in the upper region. As robot vacuum cleaner 1 moves up onto charging station 30, it pushes bearings 15 of axle 14 up the ramps 31. Ramps 31 are configured sufficiently narrow for this purpose and have the same spacing as bearings 15. Guides 6, in which bearings 15 are vertically guided, are open in a forward direction so that robot vacuum cleaner 1 is not impeded from moving further, but bearings 15 are raised.

When robot vacuum cleaner 1 is in the charging position on charging station 30, bearings 15 rest in depressions 33 formed at the top of ramps 31, and brush roller 11 is raised from the operating position to the cleaning position. In this position, brush roller 11 rotates for a predetermined period of time while blade 20 is in engagement with bristles 12. The suction fan is operated at the same time to suck in hairs or threads which have been removed from brush roller 11. Provision may be made to briefly operate brush roller 11 at a speed higher than the speed normally used during operation in order to achieve a good cleaning effect and to reduce the duration of the cleaning cycle. The increased rotational speed has the positive side effect that cut hairs or threads or other dirt particles trapped in brush roller 11 are hurled out of brush roller 11 by increased centrifugal forces.

To enable brush roller 11 to be also manually cleaned or replaced, brush roller 11 may be designed to be removable by a user of robot vacuum cleaner 1. In a refinement of robot vacuum cleaner 1, provision is made that the blade be pivotally mounted in order to prevent the risk of getting injured by blade 20, especially during removal and reinstallation of brush roller 11. In this case, the pivoting mechanism may particularly advantageously be coupled to springs in guide 6 in such a way that blade 20 is pivoted out of the gripping range of the hand of a user when brush roller 11 is removed.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE NUMERALS

1 robot vacuum cleaner
2 housing
3 bottom
4 recess
5 drive wheel
6 guide
10 brush roller unit
11 brush roller
12 bristle
13 rib
14 axle
15 bearing
16 spring
20 blade
30 charging station
31 ramp
32 upwardly sloping cam surface
33 depression

What is claimed is:

1. A robot vacuum cleaner, comprising:
a housing;
a brush roller disposed at a bottom of the housing, the brush roller being rotatable about a horizontal axle; and
a blade disposed above the brush roller in stationary relation with respect to the housing,
wherein the horizontal axle is adjustable in height relative to the housing, the brush roller being spaced away from the blade in a lower position and being in engagement with the blade in an upper position.

2. The robot vacuum cleaner of claim 1, wherein the horizontal axle is mounted in laterally disposed bearings that are configured to be vertically movably guided in one or more guides.

3. The robot vacuum cleaner of claim 1, wherein the brush roller is urged into the lower position by springs.

4. The robot vacuum cleaner of claim 1, wherein the blade is configured to extend over substantially the entire width of the brush roller.

5. The robot vacuum cleaner of claim 1, wherein the blade points obliquely downwardly.

6. A method for cleaning a brush roller of a robot vacuum cleaner, the method comprising:
the robot vacuum cleaner traveling to a charging station;
the robot vacuum cleaner moving onto a ramp of the charging station, thereby raising the brush roller relative to a housing of the robot vacuum cleaner and bringing the brush roller into engagement with a blade disposed above the brush roller in the housing; and
rotating the brush roller while it is in engagement with the blade.

7. The method of claim 6, further comprising rotating the brush roller for a predetermined period of time at a speed higher than an operating speed of the brush roller during vacuuming.

8. The method of claim 6, further comprising operating a suction fan of the robot vacuum cleaner while the brush roller rotates.

* * * * *